US009364838B2

(12) United States Patent
Parmentier

(10) Patent No.: US 9,364,838 B2
(45) Date of Patent: Jun. 14, 2016

(54) HEAD FOR DISPENSING A FLUID PRODUCT

(75) Inventor: Alexandra Parmentier, Menilles (FR)

(73) Assignee: APTAR FRANCE SAS, Le Neubourg (FR)

( * ) Notice: Subject to any disclaimer, the term of this patent is extended or adjusted under 35 U.S.C. 154(b) by 148 days.

(21) Appl. No.: 13/982,905

(22) PCT Filed: Feb. 15, 2012

(86) PCT No.: PCT/FR2012/050326

§ 371 (c)(1),
(2), (4) Date: Jul. 31, 2013

(87) PCT Pub. No.: WO2012/110744

PCT Pub. Date: Aug. 23, 2012

(65) Prior Publication Data

US 2013/0306757 A1 Nov. 21, 2013

(30) Foreign Application Priority Data

Feb. 18, 2011 (FR) ..... 11 51347

(51) Int. Cl.
*B05B 1/34* (2006.01)
*B05B 11/00* (2006.01)

(52) U.S. Cl.
CPC ..... *B05B 1/3421* (2013.01); *B05B 1/3436* (2013.01); *B05B 11/304* (2013.01); *B05B 11/3025* (2013.01)

(58) Field of Classification Search
CPC .. B05B 1/3436; B05B 11/304; B05B 11/3025
USPC ..... 239/468, 461, 469, 471, 537, 538, 539, 239/541, 302, 333, 337, 463, 474, 486–497, 239/470; 222/505, 507, 402.1, 321.9, 222/321.8, 321.7, 320
See application file for complete search history.

(56) References Cited

U.S. PATENT DOCUMENTS 5,211,317 A * 5/1993 Diamond et al. ..... 222/394
5,388,766 A * 2/1995 Buisson ..... 239/333

(Continued)

FOREIGN PATENT DOCUMENTS

ES 2011142 A6 12/1989
FR 2396595 A1 2/1979

OTHER PUBLICATIONS

International Search Report for PCT/FR2012/050326, dated Jun. 1, 2012.

(Continued)

*Primary Examiner* — Justin Jonaitis
(74) *Attorney, Agent, or Firm* — Sughrue Mion, PLLC

(57) ABSTRACT

A fluid dispenser device comprising a pre-compression pump (6) and a dispenser head (T);

the pump including an actuator rod (65) that is movable downwards and upwards, and a pre-compression spring (69) for increasing the pressure in a pump chamber (60);

the head (T) including an inlet well (14) for connecting to the actuator rod (65), and a nozzle (4) for forming a spray through a dispenser orifice (43), the nozzle being mounted in an assembly housing (2);

the dispenser device being characterized in that:

the pre-compression spring (69) presents stiffness that is less than about 3 N/mm, e.g. of about 1 N/mm to 3 N/mm; and at least two feed ducts (15), each connecting the inlet well (14) to the assembly housing (2).

14 Claims, 4 Drawing Sheets

(56) References Cited

U.S. PATENT DOCUMENTS

| | | | | |
|---|---|---|---|---|
| 6,158,617 | A * | 12/2000 | Hershey et al. | 222/1 |
| 6,609,666 | B1 * | 8/2003 | Blake | 239/464 |
| 2004/0227016 | A1 * | 11/2004 | Yagi et al. | 239/524 |
| 2007/0257067 | A1 * | 11/2007 | Parmentier et al. | 222/507 |
| 2011/0303768 | A1 * | 12/2011 | Cornet et al. | 239/463 |

OTHER PUBLICATIONS

English translation of the International Preliminary Report on Patentability for PCT/FR2012/050326.

* cited by examiner

HEAD FOR DISPENSING A FLUID PRODUCT

CROSS REFERENCE TO RELATED APPLICATIONS

This application is a National Stage of International Application No. PCT/FR2012/050326 filed Feb. 15, 2012, claiming priority based on French Patent Application No. 11 51347 filed Feb. 18, 2011, the contents of all of which are incorporated herein by reference in their entirety.

The present invention relates to a fluid dispenser device for associating with a fluid reservoir, thereby constituting a fluid dispenser. The dispenser device comprises a pre-compression pump and a dispenser head associated with the pump so as to be able to actuate it. This design is entirely conventional in the fields of perfumery, cosmetics, and pharmacy.

In general, the pre-compression pump includes an actuator rod that is movable downwards and upwards in a pump body against a return spring. A piston is mounted on the actuator rod and the movement of the piston by means of the actuator rod makes it possible to vary the volume of a pump chamber, thereby putting the fluid contained in the chamber under pressure. The pre-compression pump further includes a pre-compression spring that acts on the piston so as to increase the pressure in the pump chamber during the stage of compressing the chamber. This design is entirely conventional for a pre-compression pump.

In addition, the dispenser head generally includes an inlet well for connecting to the top end of the actuator rod. The head also includes a spray nozzle that makes it possible to form a spray through a dispenser orifice. The head is mainly formed by a head body that defines the inlet well and an assembly housing in which the nozzle is mounted. This design is also entirely conventional for a dispenser head. In general, the inlet well is connected to the assembly housing via a feed duct. The duct opens out into the assembly housing that co-operates with the nozzle to form an annular gap in which the fluid may flow. From the annular gap, the fluid flows into two or three swirl channels that are connected in tangential manner to a swirl chamber that is centered on the dispenser orifice. Likewise, this design is entirely conventional for a dispenser head.

The pre-compression spring presents stiffness that is about 6 newtons per millimeter (N/mm). The stiffness of the return spring is about 1.5 N/mm. This results in an actuation force on the dispenser head that is about 2 kilograms (kg).

When such a pre-compression pump is associated with such a dispenser head, a spray of good quality is obtained, but it is necessary to press by means of a finger, generally the index finger, on the dispenser head with a large actuation force of about 2 kg or more. As a result, actuation of the dispenser device requires a considerable effort, such that actuation may be referred to as "hard". Increasingly, users desire actuation of the dispenser device to be easier or softer: in other words, the actuation force must be reduced. However, reducing the actuation force leads to a quality of spray that is poor or unacceptable. Instead of having a spray, a jet is obtained that is made up of droplets that are excessively large.

Consequently, there are two requirements that, à priori, appear to be contradictory, namely reducing the actuation force exerted on the dispenser head while also obtaining a spray of good quality. If the actuation force is reduced, the quality of the spray is poor, and if it is desired to obtain a spray of good quality, it is necessary to maintain the actuation force at a high level of about 2 kg or more.

An object of the present invention is to provide a solution that makes it possible to reconcile these two apparently contradictory requirements in a dispenser device that presents particular characteristics. Specifically, the present invention proposes a fluid dispenser device comprising a pre-compression pump and a dispenser head, the pump including an actuator rod that is movable downwards and upwards, and a pre-compression spring for increasing the pressure in a pump chamber, the head including an inlet well for connecting to the actuator rod, and a nozzle for forming a spray through a dispenser orifice, the nozzle being mounted in an assembly housing, the dispenser device being characterized in that the pre-compression spring presents stiffness that is less than about 3 N/mm, e.g. of about 1 N/mm to 3 N/mm, and at least two feed ducts, each connecting the inlet well to the assembly housing. It is in entirely empirical manner that it has been found that spray of excellent quality is obtained when these two characteristics are combined, namely small stiffness for the pre-compression spring and a plurality of feed ducts. Spray of exceptional quality is obtained when the pre-compression spring presents stiffness of about 2 N/mm.

According to another advantageous characteristic of the invention, the pump includes a return spring for returning the actuator rod to its rest position, and the actuation force for pressing the actuator rod down from its rest position, against the return and pre-compression springs, is substantially less than 2 kg, advantageously being equal to 1.5 kg±0.2 kg. Compared to a conventional pre-compression pump, this produces actuation that is easy or soft and that is felt in very pronounced manner when the dispenser head is actuated. The surprising effect lies in the fact that the quality of the spray is remarkable, whereas the actuation force is low.

According to another advantageous characteristic of the invention, each of the feed ducts presents a section lying in the range about 0.3 square millimeters ($mm^2$) to 0.7 $mm^2$.

In another advantageous aspect of the invention, a swirl system is provided upstream from the dispenser orifice, the system comprising at least two swirl channels that are connected in tangential manner to a swirl chamber that is centered on the spray orifice, each swirl channel being fed by a feed duct. An explanation of the good quality of spray obtained with the invention lies, in part, in the fact that each swirl channel is fed by its own feed duct directly from the inlet well, in such a manner as to feed the swirl channels in completely symmetrical manner. The softness of the actuation force is thus compensated for by small head loss in the dispenser head.

In an advantageous practical embodiment, a pin extends in the assembly housing, the pin defining a side wall and a front wall, the nozzle presenting a cup shape comprising a substantially-cylindrical wall having an end that is closed by a dispenser wall that forms a spray orifice, the nozzle being assembled along an axis X in the assembly housing, with its cylindrical wall engaged around the pin, and its dispenser wall in axial abutment against the front wall of the pin, the cylindrical wall of the nozzle being in sealing contact with the side wall of the pin so as to define at least two connection sections, each connecting a feed duct to a swirl channel. Advantageously, the front wall of the pin forms at least two swirl channels that are connected in tangential manner to a swirl chamber that is centered on the spray orifice. Advantageously, the cylindrical wall of the nozzle is in sealing contact with the side wall of the pin at at least two sealing zones that extend in substantially axial manner from the ducts to the channels so as to form the two connection sections. Preferably, the sealing zones are formed by axial splines on the pin that are in contact with the cylindrical wall of the nozzle.

The axial splines, possibly combined with the radial sealing ridges, thus make it possible to define two distinct connection sections, each making it possible to connect a feed duct to a swirl channel.

In another advantageous aspect of the invention, the inlet well extends along an axis Y that is transverse relative to the axis X, such that the feed ducts are connected over the height of the well, the heights of the two ducts in the well, along the axis Y, being identical. Thus, the fluid present in the inlet well flows identically along the feed ducts in homogenous and equivalent manner without giving priority to any duct. In this way, the swirl channels are fed in completely symmetrical and balanced manner. The flow paths of the fluid from the inlet of the feed ducts to the spray orifice, via the feed ducts, the connection sections, the swirl channels, and the swirl chamber, are identical in length and in configuration.

In another aspect of the invention, the housing and the cylindrical wall of the nozzle are circularly symmetrical around the axis X. Thus, it is not necessary to orientate the nozzle angularly relative to the axis X in order to insert it inside its assembly housing. Given that the orientation of the swirl channels and of the connection sections is imposed by the pin that is stationary relative to the assembly housing, and since the nozzle is circularly symmetrical, it cannot intervene and change their orientation.

The invention thus rests on the combination of two characteristics, namely small stiffness for the pre-compression spring together with a plurality of feed ducts, making it possible to soften the actuation of a dispenser device without prejudicing the quality of its spray.

The invention is described more fully below with reference to the accompanying drawing that shows an embodiment of the invention by way of non-limiting example.

Reference is made to FIGS. 1 to 4 taken together in order to describe in detail the component parts, the assembly method, and the advantages of a dispenser head made in accordance with a non-limiting embodiment of the invention.

The dispenser head comprises two essential component parts, namely a head body 1 and a nozzle 4. The two parts can be made by injection-molding plastics material. The head body 1 is preferably made as a single part: however, it could be made from a plurality of parts that are assembled together. The same applies for the nozzle 4 that is preferably made as a single part.

Figure 2:
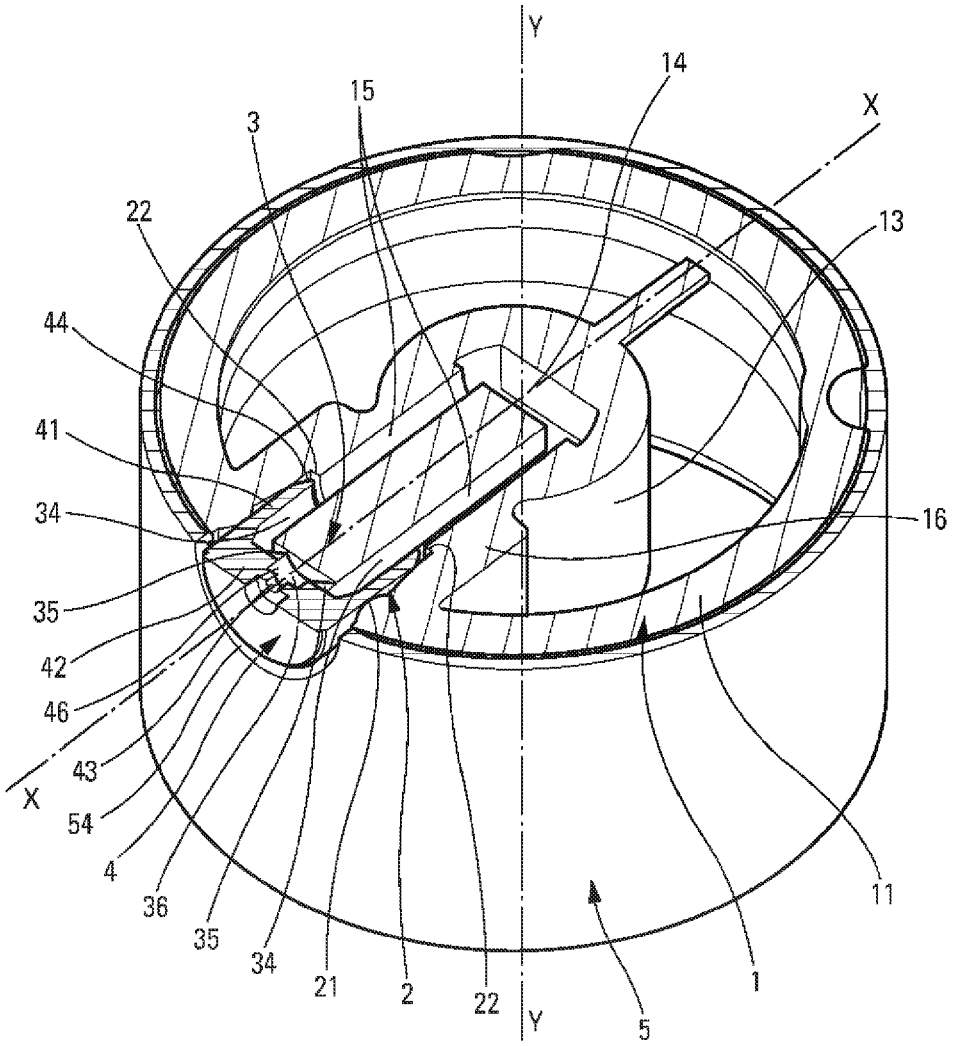
FIG. 2 is a horizontal cross-section view through the FIG. 1 dispenser device in its assembled state.

The head body 1 includes a substantially-cylindrical peripheral skirt 11 that is closed at its top end by a disk 12. The head body 1 also includes a connection sleeve 13 that, in this embodiment, extends in coaxial manner inside the peripheral skirt 11. The connection sleeve 13 extends downwards from the disk 12. The connection sleeve internally defines an inlet well 14 that is open at its bottom end, and that is closed at its top end by the disk 12. The connection sleeve 13 is for mounting on the free end of an actuator rod of a dispenser member, such as a pump or a valve. The actuator rod (not shown) is movable downwards and upwards along the axis Y. The actuator rod is hollow so as to define a flow duct that is in communication with the metering chamber of the pump or the valve. The inlet well 14 extends upwards, extending the actuator rod so that the fluid coming from the metering chamber can flow into the inlet well 14. The connection sleeve 13 is connected to the peripheral skirt 11 via a connection block 16, as can be seen in FIG. 2. The block 16 extends beneath the disk 12 along an axis X that is perpendicular to the axis Y in this embodiment. This could be otherwise. The connection block 16 internally defines two feed ducts 15 and an axial assembly housing 2. The block 16 also defines a pin 3 that projects inside the assembly housing 2. The two feed ducts 15 connect the inlet well 14 to the assembly housing 2, as can be seen very clearly in FIG. 2. It should also be observed in this figure that the two feed ducts 15 are connected to the inlet well 14 at the same height on the axis Y. The feed ducts 15 preferably have sections that are identical, and configurations that are identical. It can be said that they are disposed in symmetrical manner about the axis X. The pin 3 is also disposed on the axis X. The axial assembly housing 2 is of generally cylindrical configuration, thereby defining an inside wall 21 that is substantially cylindrical and an end wall 22 that is of complex shape. The feed ducts 15 open out into the assembly housing 2 at the end wall 22. This can be seen more clearly in FIG. 3. It should also be observed in this figure that the inside wall 21 presents fastener profiles enabling the nozzle to be held more securely, as described below.

Figure 1:
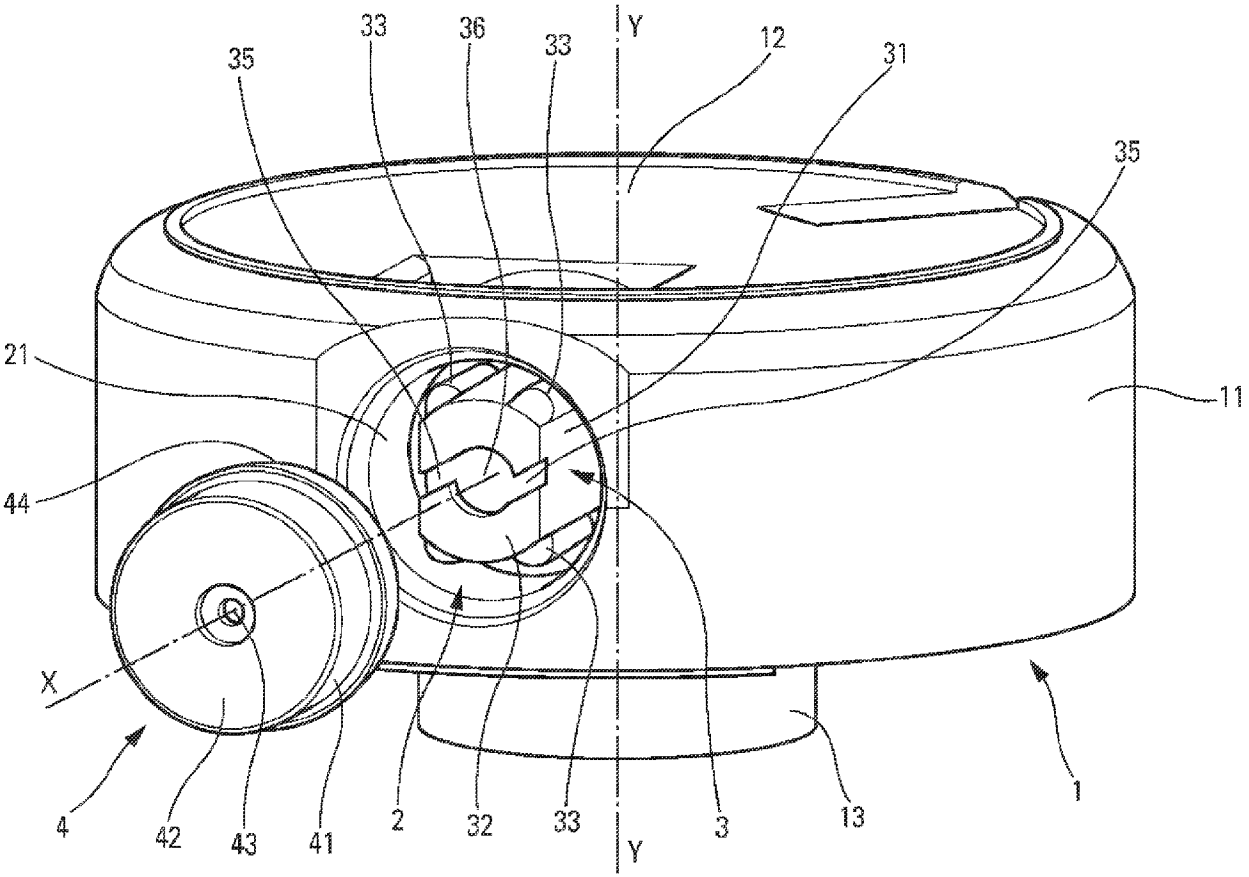
FIG. 1 is a very greatly enlarged exploded perspective view of a dispenser head in an embodiment of the invention.
Figure 3:
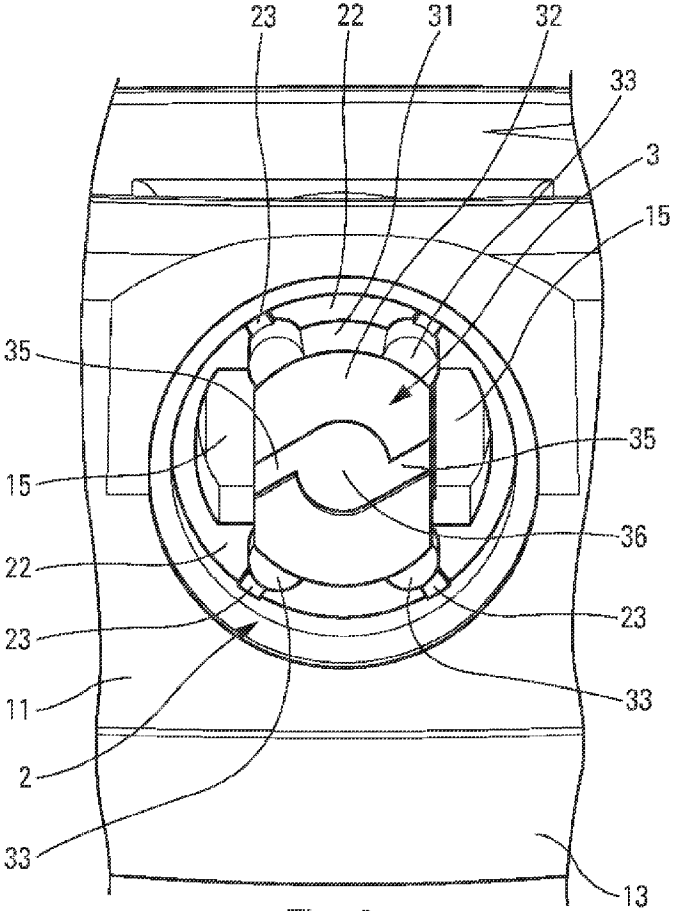
FIG. 3 is a larger-scale almost front view of the axial assembly housing of the dispenser head in FIGS. 1 and 2.

The pin 3 thus projects into the assembly housing 2 from the end wall 22. The feed ducts 15 open out into the assembly housing 2 on either side of the pin 3, as can be seen in FIG. 3. The pin 3 includes a side wall 31 that extends from the end wall 22 to a front wall 32 that defines the free end of the pin. The pin extends into the housing without coming into contact with its inside wall 21. In other words, the side wall 31 of the pin is not in contact with the inside wall 21 of the housing. The front wall 32 of the pin does not project out from the housing: on the contrary, it remains set back inside the housing. This can be seen clearly in FIG. 2. The front wall 32 of the pin is formed with a hollow profile that defines two tangential swirl channels 35 that are connected in tangential manner to a swirl chamber 36 that is centered on the axis X. The channels 35 open out onto the side wall 31 of the pin, as can be seen in FIG. 1. In addition, the side wall 31 of the pin is formed with four splines 33 that advantageously extend in axial manner along the axis X. The splines 33 extend from the front wall 32 to the end wall 22 of the housing 2. Where it connects with the end wall 22, each spline 33 extends in the form of a radial sealing ridge 23 that extends, advantageously diagonally, until it comes into contact with the inside wall 21 of the assembly housing 2. In general, the pin 3 presents a vertical section that is substantially rectangular, or at least elongate: the four corners of the rectangle being formed by the splines 33. The two feed ducts 15 extend along the long vertical sides of the rectangle formed by the pin. In a variant, the pin 3 could also present a section that is round or circular with four splines 33.

Figure 4:
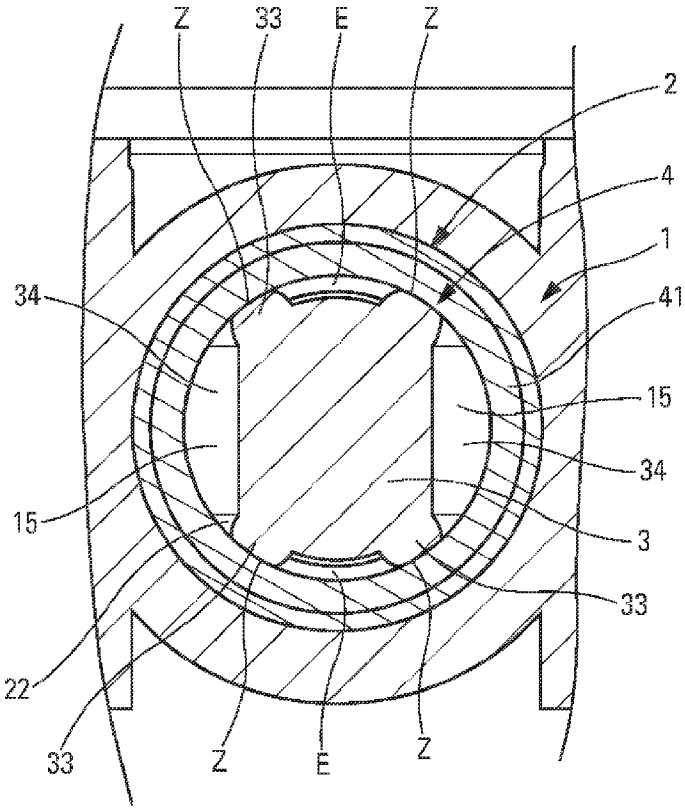
FIG. 4 is a vertical section view of the dispenser head of the present invention on a plane passing through the pin and the nozzle.

The nozzle 4 presents a substantially-conventional configuration in the shape of a cup, thereby comprising a substantially-cylindrical wall 41 that is open at one end and that is closed at its opposite end by a dispenser wall 42 in which there is formed a spray orifice 43. At its open end, the cylindrical wall 41 defines a free annular edge 44. The nozzle 4 is a part that is preferably circularly symmetrical about an axis X, as shown in FIG. 1. In other words, the nozzle 4 does not need to be oriented angularly, prior to being presented in front of the inlet of the axial assembly housing 2. This represents a great advantage compared to prior-art document EP-0 802 827. Thus, the nozzle 4 can be engaged axially without any particular orientation in the axial assembly housing 2, as shown in FIG. 1. Once axial assembly has been completed, the nozzle 4 is in the configuration shown in FIG. 2. Its dispenser wall 42 comes into leaktight contact with the front wall 32 of the pin 3, in such a manner as to isolate and finish off the swirl channels 35 and the swirl chamber 36. It can even be observed in FIG. 2 that the dispenser wall 42 internally forms a portion 46 of the swirl chamber, in addition to the swirl chamber 36 formed in the pin. In addition, the cylindrical wall 41 of the nozzle 4 comes into clamping and leaktight contact with the inside wall 21 of the housing 2, and with the splines 33 of the pin 3, as can be seen in FIG. 4. Thus, the pin 3 and the cylindrical wall 41 of the nozzle 4 define between them four spaces, namely two connection sections 34 and two dead spaces E. The connection sections 34 connect the feed ducts 15 to the swirl channels 35. This can be seen in FIG. 2. It can also be said that the connection sections 34 extend the feed ducts 15 as far as the swirl channels 35. In addition, the dead spaces E are isolated and are not in communication with the outside. It should also be observed that the free annular edge 44 of the nozzle 4 comes into contact with the radial ridges 23 so as to complete the sealing at the end wall 22 of the housing.

It can thus be said that the nozzle 4 comes into contact with the pin 3 by defining a plurality of sealing zones Z that are formed by the splines 33 coming into contact with the side wall 41 of the nozzle. This can be seen clearly in FIG. 4. It is even possible to envisage that the splines 33 are deformed a little by the side wall 41 so as to improve sealing. In this embodiment, the sealing zones Z are four in number, but it is also possible to envisage making the dispenser head of the invention with only two sealing zones, or, on the contrary, with three sealing zones, or even with more than four sealing zones. By way of example, it is possible to replace two splines 33 by a cylinder segment that comes into intimate contact with the cylindrical wall 41 of the nozzle. In this configuration, there would not be any dead spaces E. The present embodiment is advantageous since the rectangular shape of the pin makes it possible to define two connection sections that are associated with the feed ducts 15.

It should be observed that the two swirl channels 35 are thus fed in identical, balanced, and symmetrical manner by the two feed ducts 15 and the two connection sections 34. This results from the fact that the ducts 15 and the connection sections 34 are disposed in completely symmetrical manner on either side of the axis X. In addition, given that the two feed ducts 15 leave the inlet well 14 at the same height on the axis Y, the two swirl channels, and consequently the swirl chamber 36, are guaranteed to be fed with fluid in completely symmetrical manner. Each swirl channel 35 brings the same quantity of fluid at the same speed to the swirl chamber 36, thereby encouraging the formation of a perfect vortex. It follows that the quality of the spray through the spray orifice 43 is optimum.

Without going beyond the ambit of the invention, and by way of example, it is also possible to envisage making a dispenser head including four swirl channels that are fed in symmetrical manner by two feed ducts and two connection sections: each pair of swirl channels thus being fed by one feed duct and one connection section. It is also possible to envisage making a dispenser head with three swirl channels that are fed by three feed ducts and three connection sections.

Optionally, the head body 1 may be engaged in a cover 5 that includes a side opening 54 through which the nozzle 4 can pass.

Figure 5:
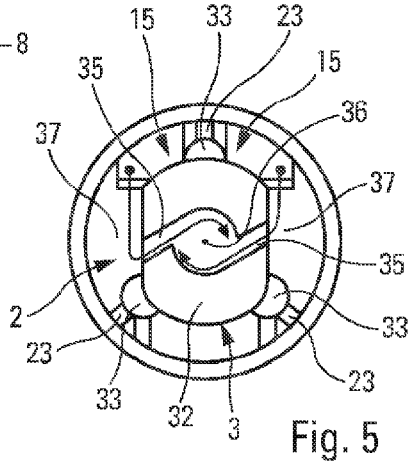
FIGS. 5 and 6 are front views of the assembly housing of the dispenser head for two variant embodiments.
Figure 6:
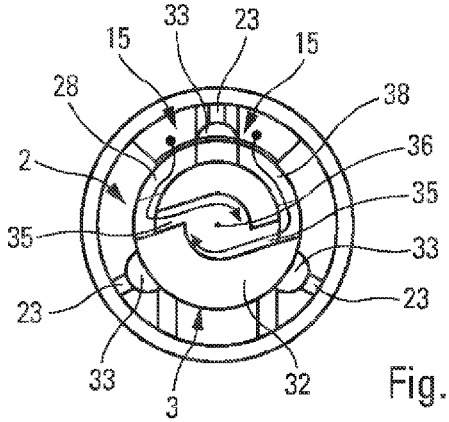

Reference is made below to FIGS. 5 and 6 which show two variant embodiments of the dispenser head of the invention. The essential difference compared to the embodiments in FIGS. 1 to 4 lies in the fact that the feed ducts 15 are not situated in diametrally-opposite manner on either side of the pin 3, but in close-together manner above the pin 3. The two ducts 15 are separated only by a single axial spline 33 in the top portion of the pin, and by two other axial splines 33 in the bottom portion of the pin. The feed ducts 15 may communicate with the swirl channels 35 via two connection spaces 37 that are formed around the pin 3 in the assembly housing 2. In FIG. 5, it should also be observed that the pin 3 is not circular, but is generally oblong in the vertical direction, with a spline 33 situated in its top portion, and two other splines laterally situated in its bottom portion. The swirl channels 35 begin at plane walls of the pin that are adjacent to the connection spaces 37.

With reference to FIG. 6, it can be observed immediately that the pin 3 is circular and includes three axial splines 33 that are situated substantially at the same levels as the splines in FIG. 5. The two feed ducts 15 are also arranged in identical manner in the top portion of the housing 2, above the pin 3. Instead of connection spaces 37, two connection recesses 38 are provided that are formed by the pin 3. The recesses 38 then extend to form the swirl channels 35.

Figure 7:
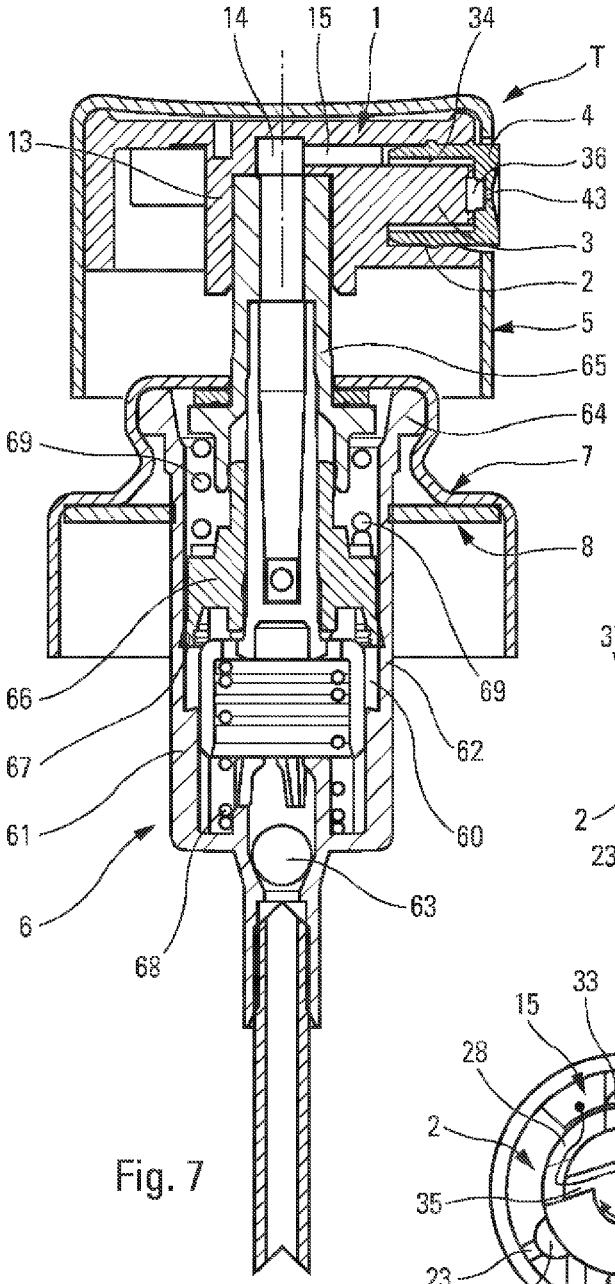
FIG. 7 is a vertical section view through a dispenser device of the invention.

The dispenser head described above with reference to FIGS. 1 to 6 is for mounting on a pump or on a valve, thereby constituting a dispenser device. Reference is made below to FIG. 7 which shows a particular dispenser device comprising a dispenser head T of the invention associated with a pre-compression pump 6. The pump 6 presents a substantially-conventional general configuration with a pump body 61 that defines, in its bottom portion, a seat for a valve 63, and, in its top portion, a collar 64 that projects radially outwards. The collar 64 may be used for fastening a fastener system 7 that may be in the form of a crimping ring, for example. Naturally, it is possible to envisage other forms of fastener system 7 for associating with the pump 6. The fastener system 7 is associated with a neck gasket 8 making it possible to provide sealing with the neck of a fluid reservoir that is not shown. The pump body 61 internally defines a cylindrical slide cylinder 62 in which there slides, in leaktight manner, a piston 66 that is provided with a sealing lip 67. The piston 66 is mounted on an actuator rod 65 that is urged into its rest position by a return spring 68. In order to create pre-compression, the piston 66 is urged by a pre-compression spring 69. The piston 66 is movably mounted on the actuator rod 65 in such a manner as to be capable of uncovering an outlet passage for the compressed fluid in the pump chamber 60. In other words, the piston 66 performs a function of outlet valve, by releasing an outlet passage when the pressure inside the pump chamber 60 reaches a predetermined value. The pre-compression spring 69 urges the piston 66 into the closed position of the outlet valve. Thus, the piston 66 may move over the actuator rod 65 only when the pressure inside the chamber 60 is sufficient to compress the pre-compression spring 69.

In a conventional pre-compression pump, the return spring 68 presents stiffness of about 1.52 N/mm (155 grams per millimeter (g/mm)). The pre-compression spring generally presents stiffness of about 6.17 N/mm (629 g/mm). However, it has been discovered in empirical manner that it is possible to reduce the stiffness of the pre-compression spring 69 considerably, without degrading the quality of the spray at the dispenser head T of the invention. The stiffness of the pre-compression spring acts directly on the resistance on actuation: by reducing the stiffness of the spring, actuation of the pump is softer or easier. Stiffness of about 2 N/mm is sufficient to ensure a spray of good quality. Very satisfactory tests have been performed with a pre-compression spring having stiffness of 2.03 N/mm (207 g/mm). However, it is possible to reduce the stiffness of the pre-compression spring 69 even further, down to about 1 N/mm, while still ensuring a spray of acceptable quality. With stiffness of about 2 N/mm, the actuation force required to actuate the dispenser head T is about 1.5 kg plus or minus 200 g. The ability to reduce the stiffness of the pre-compression spring 69 while still ensuring a spray of acceptable quality may be explained by the fact that there are a plurality of feed ducts 15 that connect the inlet well 14 directly to the assembly housing 2 in which the nozzle 4 is engaged. Preferably, there are two feed ducts 15, each of which is connected to a respective swirl channel 35 via a connection section 34 that is formed between the pin 3 and the nozzle 4, as explained above. Feeding the swirl channels in symmetrical manner via the respective feed ducts doubtless makes it possible to reduce head loss at this point in order to concentrate head loss solely in the swirl chamber 36. In any event, it has been observed that the dispenser head T with a plurality of distinct feed ducts makes it possible to reduce the stiffness of the pre-compression spring 69 considerably, without degrading the quality of the spray at the outlet of the dispenser orifice 43. It is possible that the quality of the spray also depends, in part, on the flow sections of the feed channels 15, each flow section lying in the range about 0.3 $mm^2$ to 0.7 $mm^2$.

In FIG. 7, the dispenser head T is as in the variants in FIGS. 5 and 6, in which the feed ducts 15 are situated in the top portion of the pin 3.

In summary, with the nozzle being fed in symmetrical manner and with pre-compression spring stiffness lying in the range about 1 N/m to 3 N/mm, a dispenser device is obtained that is very soft or easy to actuate, and that delivers a spray that nevertheless is of very good quality.

The invention claimed is:

1. A fluid dispenser device comprising a pre-compression pump and a dispenser head;

the pump including an actuator rod that is movable downwards and upwards, and a pre-compression spring for increasing the pressure in a pump chamber;

the head including an inlet well for connecting to the actuator rod, and a nozzle for forming a spray through a dispenser orifice, the nozzle being mounted along a first axis is X in an assembly housing; and wherein the pre-compression spring presents a stiffness that is less than about 3 N/mm; and the fluid dispenser device comprising at least two feed ducts, each communicating fluid from the inlet well to the assembly housing.

2. The dispenser device according to claim 1, wherein the pre-compression spring presents stiffness of about 2 N/mm.

3. The dispenser device according to claim 1, wherein the pump includes a return spring for returning the actuator rod to its rest position, and the actuation force for pressing the actuator rod down from its rest position, against the return and pre-compression springs, is substantially less than 2 kg.

4. The dispenser device according to claim 1, wherein each of the feed ducts presents a section lying in the range about 0.3 $mm^2$ to 0.7 $mm^2$.

5. The dispenser device according to claim 1, wherein a swirl system is provided upstream from the dispenser orifice, the system comprising at least two swirl channels that are connected in tangential manner to a swirl chamber that is centered on the spray orifice, each swirl channel being fed by a feed duct.

6. The dispenser device according to claim 1, wherein a pin extends in the assembly housing, the pin defining a side wall and a front wall, the nozzle presenting a cup shape comprising a substantially-cylindrical wall having an end that is closed by a dispenser wall that forms a spray orifice, the nozzle being assembled along an axis X in the assembly housing, with its cylindrical wall engaged around the pin, and its dispenser wall in axial abutment against the front wall of the pin, the cylindrical wall of the nozzle being in sealing contact with the side wall of the pin so as to define at least two connection sections, each connecting a feed duct to a swirl channel.

7. The dispenser device according to claim 6, wherein the front wall of the pin forms at least two swirl channels that are connected in tangential manner to a swirl chamber that is centered on the spray orifice.

8. The dispenser device according to claim 6, wherein the cylindrical wall of the nozzle is in sealing contact with the side wall of the pin at at least two sealing zones that extend in substantially axial manner from the ducts to the channels so as to form the two connection sections.

9. The dispenser device according to claim 8, wherein the sealing zones are formed by axial splines on the pin that are in contact with the cylindrical wall of the nozzle.

10. The dispenser device according to claim 1, wherein the inlet well extends along an axis Y that is transverse relative to the axis X, such that the feed ducts are connected over the height of the well, the heights of the two ducts in the well, along the axis Y, being identical.

11. The dispenser device according to claim 1, wherein flow paths of the fluid from the inlet well of the feed ducts to the spray orifice, via the feed ducts the connection sections and, the swirl channels are identical in length and the flow paths up to the swirl channels are symmetrical about the first axix X.

12. The dispenser head according to claim 1, wherein the housing and the cylindrical wall of the nozzle are circularly symmetrical around the axis X.

13. The dispenser head according to claim 3, wherein the actuation force for pressing the actuator rod down from the rest position, against the return and pre-compression springs, is equal to 1.5 kg±0.2 kg.

14. The dispenser device according to claim 1, wherein a first flow path and a second flow path of the fluid are formed from the inlet well of the feed ducts to the spray orifice, via the feed ducts, the connection sections, the swirl channels, and the swirl chamber, the first flow path and the second flow path have a same length, and the first flow path and the second flow path have a same shape and are disposed relative to each other about the first axis by a 180 degree rotation.

* * * * *